US008060978B2

(12) United States Patent
Young et al.

(10) Patent No.: US 8,060,978 B2
(45) Date of Patent: Nov. 22, 2011

(54) SURFACE SWEEPING MACHINE WITH TILTING BLOWER HOUSING

(75) Inventors: Gary B. Young, Waco, TX (US); James C. Crow, Waco, TX (US)

(73) Assignee: TYMCO, Inc., Waco, TX (US)

( * ) Notice: Subject to any disclaimer, the term of this patent is extended or adjusted under 35 U.S.C. 154(b) by 1143 days.

(21) Appl. No.: 11/198,358

(22) Filed: Aug. 8, 2005

(65) Prior Publication Data

US 2007/0028414 A1 Feb. 8, 2007

(51) Int. Cl.
*E01H 1/08* (2006.01)

(52) U.S. Cl. ..... 15/340.1; 15/340.3; 15/352

(58) Field of Classification Search ..... 15/340.1–340.4, 15/352; *E01H 1/08*
See application file for complete search history.

(56) References Cited

U.S. PATENT DOCUMENTS

| | | | | | |
|---|---|---|---|---|---|
| 3,512,206 | A | | 5/1970 | Young | |
| 3,545,181 | A | | 12/1970 | Young | |
| 3,634,904 | A | | 1/1972 | Larson | |
| 3,959,846 | A | * | 6/1976 | Yasuda | 15/331 |
| 4,227,893 | A | * | 10/1980 | Shaddock | 95/268 |
| 4,885,817 | A | * | 12/1989 | Tanase | 15/340.1 |
| 5,072,485 | A | | 12/1991 | Young | |
| 5,218,737 | A | * | 6/1993 | Dansby et al. | 15/347 |
| 5,596,788 | A | * | 1/1997 | Linville et al. | 15/352 |
| 2004/0045111 | A1 | * | 3/2004 | Engel et al. | 15/84 |

FOREIGN PATENT DOCUMENTS

| | | | |
|---|---|---|---|
| DE | 10118500 | C1 | 8/2002 |
| GB | 1203888 | A | 9/1970 |

OTHER PUBLICATIONS

German Patent Application No. 10 2006 036 016.8-25—First Office Action mailed Jan. 16, 2009.

Canadian Patent Application No. 2,555,123—Canadian Patent Office Examination Report mailed by CIPO (Canadian Intellectual Property Office) on Sep. 16, 2009.

* cited by examiner

*Primary Examiner* — David Redding
(74) *Attorney, Agent, or Firm* — Miles & Stockbridge P.C.; David R. Schaffer, Esq.

(57) ABSTRACT

A road sweeper includes a blower housing having an opening, a hopper having an opening, and the openings being in axial alignment when the hopper and blower housing are each in a sweeping position thereof. The blower housing is biased for tilting movement from its sweeping position to an inclined dump position upon relative movement of the hopper to preclude abrasion, wear and damage to an O-ring seal disposed between the openings. The blower housing can also be moved to a third repair position in which components thereof are accessible from the cab side of the sweeper.

24 Claims, 7 Drawing Sheets

SURFACE SWEEPING MACHINE WITH TILTING BLOWER HOUSING

BACKGROUND OF THE INVENTION

The present invention is directed to a surface sweeping machine, commonly referred to as a road sweeper, which utilizes a conventional truck body including a cab and a frame with the latter having mounted thereon a pick-up head, a hopper, a centrifugal separator, a blower, a blower housing, and associated openings and conduits for circulating air entrained debris through the centrifugal separator and thereby depositing debris in the hopper for subsequent discharge/dumping.

A typical road sweeper of the latter construction is found in U.S. Pat. Nos. 3,512,206 and 3,545,181, each in the name of Bernard W. Young granted on May 19 and Dec. 8, 1970, respectively. Debris from the hopper is discharged through a hydraulically opened and closed rear door. Over the years road sweepers have evolved and the assignee (Tymco, Inc.) of the present invention developed, manufactured, sold and patented a surface sweeping machine with over-the-cab hopper dumping, as is evidenced by U.S. Pat. No. 5,072,048 in the name of Gary B. Young et al. granted on Dec. 17, 1991. The road sweeper of this patent includes a hopper having an opening which is in registration with an opening of a blower housing during a sweeping operation but for dumping purposes the hopper can be pivoted away from the blower housing, while the blower housing and its associated blower/turbine remains stationary with respect to the vehicle frame.

A road sweeper disclosed in U.S. Pat. No. 3,634,904 granted on Jan. 18, 1972 to Gregory J. Larson (assigned to Wayne Manufacturing Company) discloses a road sweeper in which flexible and rigid conduits are connected to each other between a debris hopper and a suction hood or pick-up head. The hopper carries a rigid conduit which in turn carries an O-ring seal which mates against a plenum face of a coupling connected to a flexible conduit. The coupling is supported by both a compression spring and a link to the vehicle frame. When the hopper is returned from an open dumping position to a working position, the rigid upper conduit section carried thereby swings downwardly to engage and compress the O-ring seal against the plenum face 29 and also compresses the spring supporting the flexible conduit coupling. In accordance with the latter disclosure, the pivoting motion of the debris hopper thereby connects and disconnects the hopper conduit relative to the pick-up head.

U.S. Pat. No. 5,596,788 granted on Jan. 28, 1997 to Ronny E. Linville et al. discloses a road sweeper in which a pivotally mounted hopper has a pair of openings which align with openings of an inlet conduit leading from a pick-up head and a fan inlet flange of a vacuum fan housing. Gaskets are utilized with the latter openings to prevent air leakage and sealing surfaces or flanges associated therewith are canted to slope rearwardly and downwardly to provide complementary mating engagement between the sealing surfaces of the movable hopper and an immovable lower housing carried by the vehicle frame.

BRIEF SUMMARY OF THE INVENTION

The invention provides a novel road sweeper which includes a hopper pivoted between sweeping and dumping positions, a centrifugal separator associated therewith, a pick-up head, a blower housing, and associated conduits and openings creating a path of travel for air-entrained debris. In the sweeping position of the hopper and blower housing, openings thereof are in registry with each other and are sealed by an O-ring gasket or seal. However, during movement of the hopper from its sweeping position, the blower housing tilts away from the hopper virtually immediately upon hopper movement to prevent damage to the gasket or seal carried by the blower housing. The abrupt pivoting or tilting movement of the blower housing upon movement of the hopper is achieved by mounting the blower housing for pivotal movement about a pivot point which is appreciably radially beneath the hopper and blower housing openings in the sweeping/axially aligned positions thereof. As the hopper begins its upward dumping motion, preferably upward side dumping movement, through appropriate linkage mechanisms and hydraulic piston/cylinder mechanisms, the blower housing which is under constant compression spring bias is pivoted progressively during initial hopper movement toward its dumping position. As the hopper is returned by the linkage mechanism and the hydraulic mechanisms associated therewith from its dumping position to its sweeping position, an abutment plate of the hopper contacts a contact plate of the blower housing and pivots the blower housing against the biasing force of the compression springs to its sweeping position at which the blower housing and hopper openings are axially aligned. Therefore, during hopper movement in either of two directions between the hopper sweeping/home position and the hopper dumping position, the blower housing is tilted or pivoted to prevent the O-ring gasket or seal carried thereby from being damaged.

In further accordance with the present invention, a compression spring assembly is pivotally connected at opposite ends thereof to the blower housing and a portion of the vehicle frame to impart to the blower housing the biasing force heretofore mentioned to pivot the blower housing from its home/in-use sweeping position to its dumping position. However, the compression spring assembly also includes several unique structural features including variable points of pivotal connection to adjust the force of compression springs which might over long usage develop a "compression set" lower than the design parameters. By changing the point of connection between the compression spring assembly and the vehicle frame, the spring compression can be increased from an undesired lower compression set to that which is optimum.

A further feature of the compression spring assembly is the provision of a pivotal connection between the same and the frame of the road sweeper at which the blower housing can be pivoted in a direction opposite to its pivotal movement toward its dumping position, while the hopper is in its dumping position, to permit inspection, repair and/or replacement of the blower motor, fan and associated components from a forward side or cab side of the blower housing. In the latter "repair" position the blower housing need not be removed from the vehicle which is extremely desirable from the standpoint of convenience and efficiency of repair and the corresponding lessening of down-time associated therewith.

The blower housing is also pivotally secured to the vehicle frame by a pair of adjusting mechanisms which permit the blower housing opening to be accurately aligned with the hopper opening in the sweeping position. Each adjusting mechanism for adjusting the blower housing pivot includes a pair of plates which can be relatively adjusted vertically upwardly, downwardly, sideways and fore and aft to assure alignment of the axes of the blower housing and hopper openings which in turn assures an effective seal by the O-ring gasket disposed therebetween and accompanying efficient sweeping operations under minimal cost.

With the above and other objects in view that will hereinafter appear, the nature of the invention will be more clearly understood by reference to the following detailed description, the appended claims and the several views illustrated in the accompanying drawings.

DETAIL DESCRIPTION OF THE PREFERRED EMBODIMENTS

Figure 1:
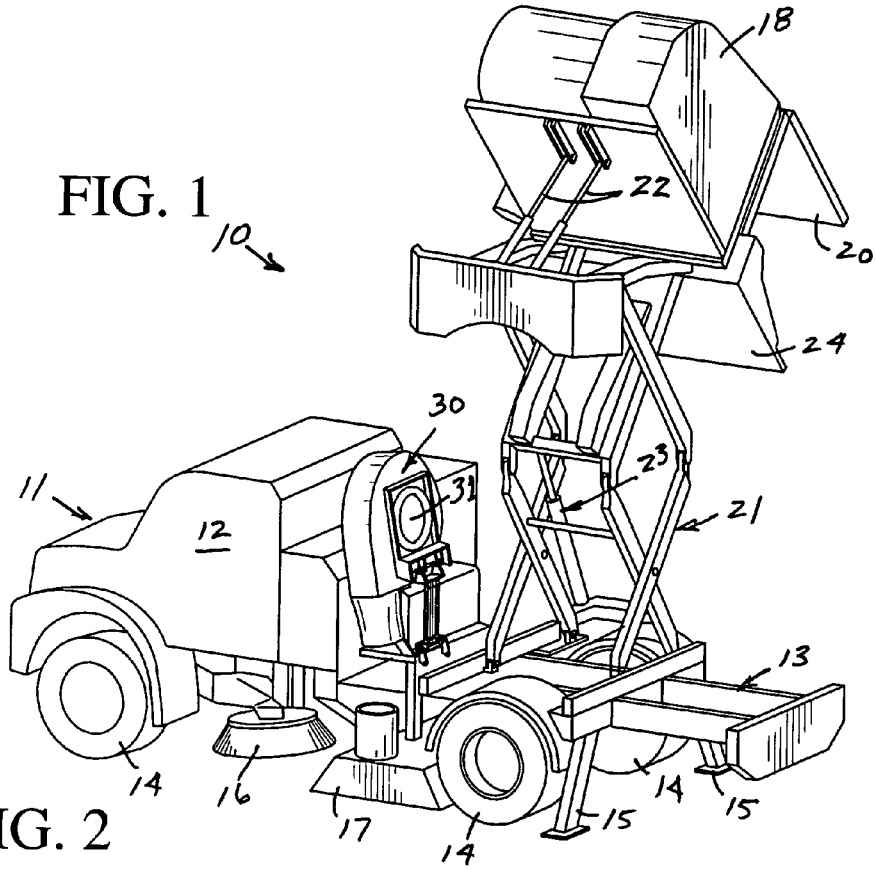
FIG. 1 is a schematic side perspective view, and illustrates a road sweeper with a hopper thereof in its side dumping position and a blower housing tilted/pivoted forward toward a cab of the road sweeper.

A surface sweeping machine with a tilting or pivoting blower housing is illustrated in FIG. 1 of the drawings and is generally designated by the reference numeral 10. The surface sweeping machine or road sweeper 10 can be utilized for sweeping roads, aircraft runways, tarmacs or the like and includes a conventional vehicle 11 defined by a cab 12, a frame 13, wheels 14, outriggers 15, gutter brooms 16, a pick-up head 17, a hopper 18 internally of which is a centrifugal separator (not shown), a door 20 and a linkage mechanism 21 operated by pairs of fluid motor and piston mechanisms 22, 23 associated with a conventional high pressure hydraulic motor or pump, valves, lines and the like to extend and retract the fluid motor and piston mechanisms 22, 23 to move the hopper 18 between a first home or sweeping position (FIGS. 2 and 5) and a second side dumping position (FIG. 1).

A blower housing 30 occupies a similar first working or sweeping position (FIGS. 2 and 5) and a second dumping position (FIGS. 1 and 3) when the hopper 18 is in its respective sweeping and dumping positions. In the sweeping position of the blower housing 30 and the hopper 18 a debris compartment 25 (FIG. 5) of the hopper 18 is placed in fluid communication through an opening 29 of a conduit 26 having a radially outward directed sealing flange 27 with an opening 31 of the blower housing 30 which opens into an interior blower chamber 32 thereof. A blower or fan 33 is carried by a shaft 34 which is rotated by a fluid motor 35 bolted to a motor housing 36 which is in turn bolted outboard of an opening (not shown) in a front wall 37 of the blower housing 30 which is of a size sufficient to remove therethrough the blower or fan 33 in a manner to be described herein. As the blower or fan 33 is rotated by the fluid motor 35 when the hopper 18 and the blower housing 30 are disposed in the sweeping positions thereof best shown in FIGS. 2 and 5, high-speed air is circulated through appropriate conduits, the pick-up head 17, etc. to deposit debris in the hopper 18 for subsequent dumping, much in the manner more specifically described in the patent to B. W. Young (U.S. Pat. No. 3,545,181) which is herein incorporated by reference.

Figure 5:
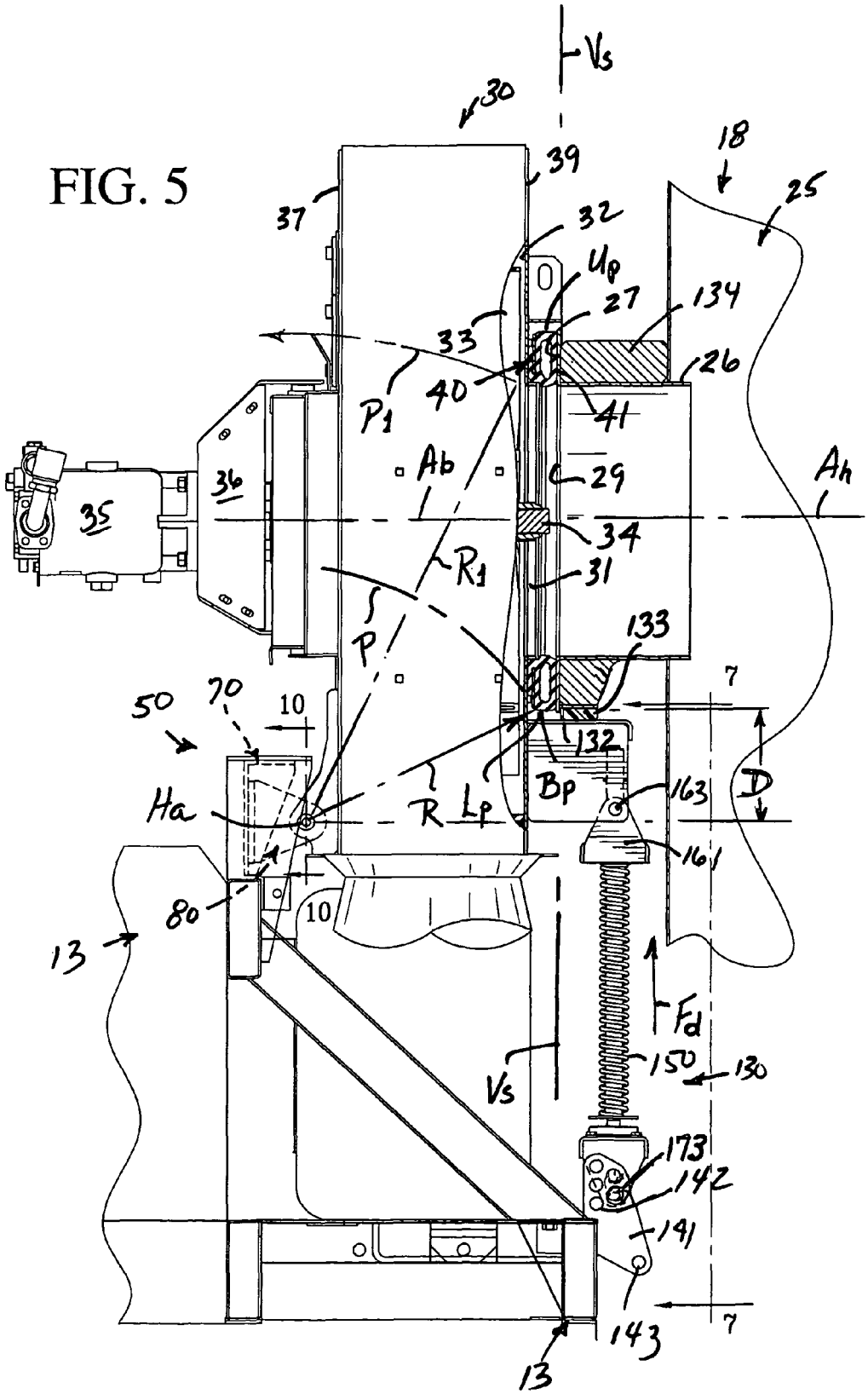
FIG. 5 is an enlarged fragmentary side elevational view with portions broken away for clarity similar to FIG. 3, and illustrates the blower housing and the hopper in the home/sweeping positions thereof with the O-ring gasket compressed in sealed relationship about the aligned blower housing and hopper openings.

A substantially annular hollow O-ring seal or gasket 40 (FIGS. 1 and 3-5) surrounds the opening 31 of the blower housing 30 and includes an annular sealing face or surface 41 and opposite thereto an annular radially outwardly directed securing flange 42 which defines a securing slot 43 with an inboard annular wall 44 of the O-ring seal 40. A plurality of radially inwardly directed brackets or a single annular radially inwardly directed bracket 45 is secured to a rear wall 39 of the blower housing 30 by bolts 49 threaded through openings (not shown) of the bracket 45 into threaded bores of bosses 69 projecting from the rear wall 39. The O-ring seal 40 is located in the slot 43 to retain the O-ring seal 40 assembled to the blower housing 30 for compressively seating against and sealing the sealing flange 27 (FIG. 5) of the pipe or conduit 26 which lies in a vertical sealing plane Vs (FIG. 5)

which is normal to coaxial axes Ab and Ah of the blower housing and hopper openings 31, 29, respectively, when the blower housing 30 and the hopper 18 are in the first or sweeping positions thereof (FIG. 5).

A pair of identical mechanisms or means 50, 50 (FIGS. 3, 5, 7 and 10 through 12) mount the blower housing 30 for pivotal or tilting movement between the in-use/sweeping position (FIG. 5), the dumping position (FIG. 3) and the repair position (FIG. 5), and can be adjusted in X, Y and Z planes.

Each of the pivotal connecting means 50 includes a relatively rigid metal L-beam or L-support 51 defined by a vertical flange 52 (FIG. 11) and a horizontal flange 53. The vertical flange 52 and the horizontal flange 53 are each welded to a portion (unnumbered) of the vehicle frame 13, and the horizontal flange 53 projects toward the rear of the vehicle 11. The horizontal flange 53 of each L-support 51 includes three cross-slots 54 (FIGS. 10 and 11) through the outboard two of which pass bolts 55 (FIG. 10) and through the center one of which passes a jack screw 56. The bolts 55 and jack screw 56 also pass through openings 61 of a horizontal flange 62 of another L-shaped member 60 having a vertically upwardly directed flange 63. Heads (unnumbered) of the bolts 55 and the jack screw 56 rest atop the flange 62 of the L-shaped member 63 and are respectively threaded to nuts 57 and 95.

An intermediate support member 70 of each of the pivotal mounting mechanism 50 includes a horizontal flange 71, a vertical flange 72 and a pair of spaced angular gussets 73, 73 (FIG. 10) welded along edges to the flanges 71, 72. The flange 71 has a pair of elongated slots 74 (FIG. 11) through each of which passes one of the bolts 55 and therebetween another slot or opening 74 through which passes the jack screw 56 (FIG. 12). The vertical flange 72 includes a pair of vertically aligned slots 76, 76 (FIG. 12) through which pass bolts 77, 77. The slots 76 and bolts 77 having nuts 78 fastened thereto provide vertical up and down adjusting motion of the blower housing 30 of approximately one inch in each direction in conjunction with a pillow block 80.

The pillow block 80 is defined by a horizontal flange 81, a vertical flange 82 and spaced side gussets 83, 83 (FIG. 11) which are welded to the flanges 81, 82. The jack screw 56 passes through an opening 94 in the horizontal flange 81 and is threaded into the nut 95 (FIG. 12). The bolts 77 which pass through the vertical slots 76 (FIG. 12) in the vertical flange 72 of the intermediate support member 70 pass through openings 96 in the vertical flange 82 of the pillow block 80 and the nuts 78 fastened thereto secure each pillow block 80 in a desired vertical position.

Figure 10:
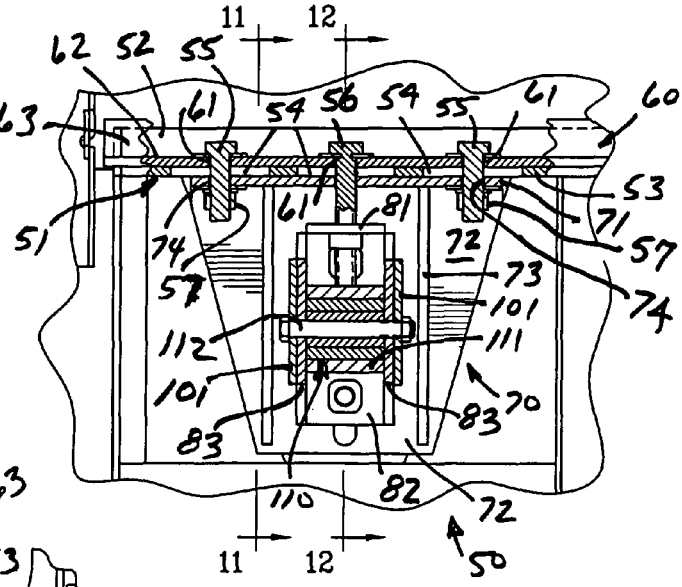
FIG. 10 is a fragmentary view looking from the rear of the vehicle toward the front, and illustrates one of the two pivot mounting mechanisms, a jack screw for vertical adjustment and a plurality of locking bolts and nuts.
Figure 11:
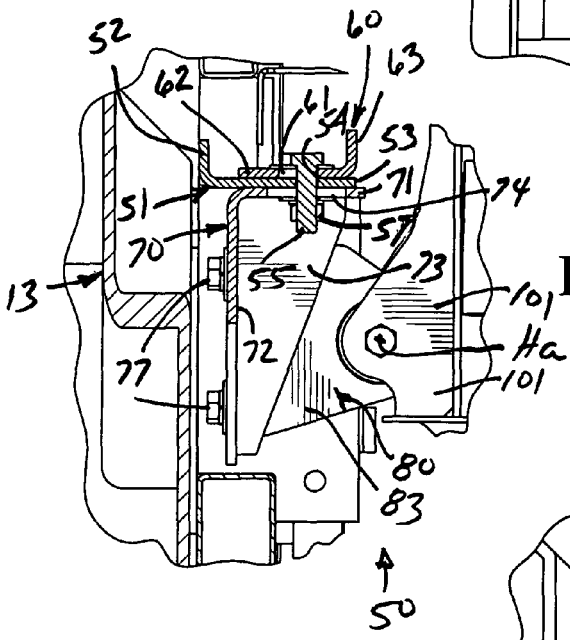
FIG. 11 is a fragmentary cross-sectional view taken generally along line 11-11 of FIG. 10, and illustrates a vertical gusseted connector plate through which pass a pair of bolts for locking a pivot plate in a position of selected vertical adjustment.
Figure 12:
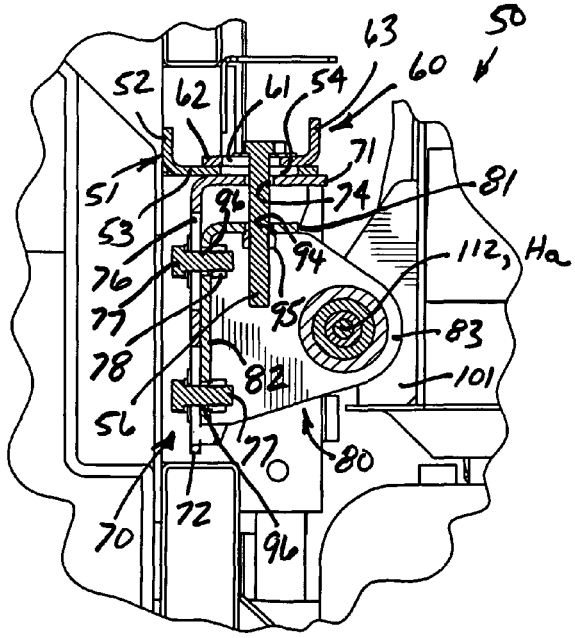
FIG. 12 is a fragmentary cross-sectional view taken generally along line 12-12 of FIG. 10, and illustrates details of the jack screw, the vertical adjustment locking bolts and nuts, and a pivotal connection between the pivotal connector plate and the blower housing.

Each pivotal mounting mechanism 50 further includes a pair of spaced plates 101, 101 which are welded along horizontal and vertical edges thereof (unnumbered) and house therebetween the plates 83, 83 (FIGS. 10 and 11). A conventional noise and vibration-dampening connection is provided between the plates 83, 83 and 101, 101 through a tubular collar 111 welded to the plates 83, 83 internally of which are annular sleeves of sound damping material, such as rubber, and an axial bolt 112 passing through apertures or openings (unnumbered) in the plates 83, 83, 101, 101 and fastened as evident in FIG. 11. The latter affords a sound and vibration dampening pivotal or tilting connection between the blower housing 30 and the vehicle frame 13 at a horizontal axis Ha (FIGS. 3 and 5) which is appreciably radially outboard of and substantially beneath a lowermost bottom portion Bp of the O-ring seal 40 which precludes damage thereto upon opening and closing pivoting movement of the blower housing 30 relative to the hopper 18 in a manner to be described more fully hereinafter.

As is most readily apparent from FIGS. 11 and 12 of the drawings, the horizontal axis Ha can be shifted vertically by moving the intermediate mounting member 80 vertically upwardly and downwardly when the bolts 77 are lose and thereafter tightening the same relative to the nuts 78 upon achieving desired vertical adjustment. Since vertical adjustment requires lifting or lowering of the entire blower housing 30 and all components associated therewith, each of the jack screws 56 can be threaded or unthreaded utilizing an appropriate socket wrench and/or power tool. Forward and aft and/or sidewise adjusting movement of the blower housing 30 is accomplished by shifting the intermediate L-member or support 70 via the cross slots 54 thereof and the bolts 55 as found necessary or desirable. The latter adjustments in the X, Y and Z directions are provided to assure coaxial alignment of the axes Ab and Ah of the respective openings 31, 29 of the blower housing 30 and the hopper 18 in the working or sweeping position thereof (FIG. 5).

Figure 3:
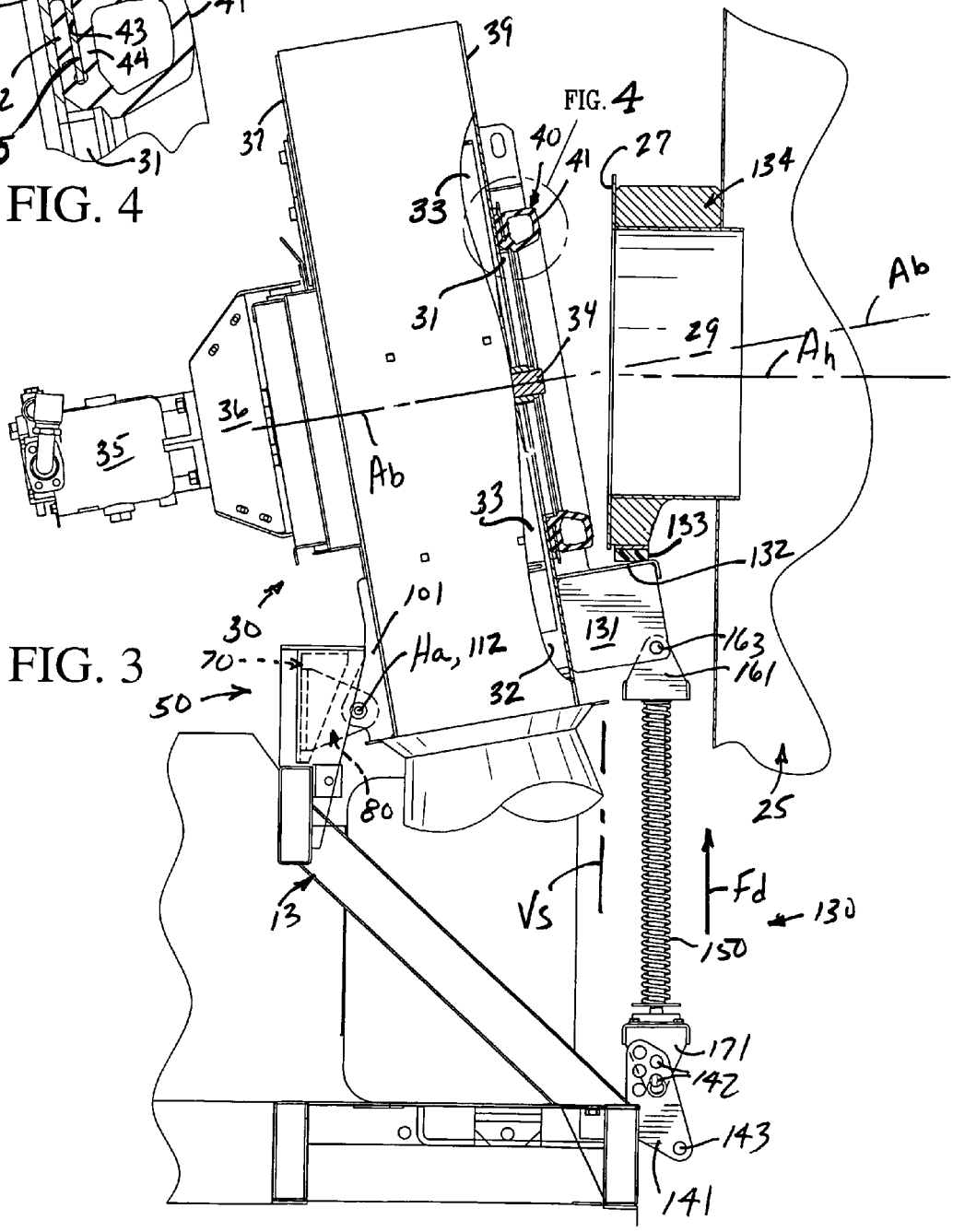
FIG. 3 is an enlarged fragmentary side elevational view with parts broken away for clarity, and illustrates the blower housing including an opening thereof, an O-ring gasket or seal surrounding the opening, an opening of the hopper and the housing pivoted or tilted counterclockwise from the position shown in FIG. 2 under the influence of the compression spring assembly as the hopper is raised initially from its home/sweeping position upwardly and sidewise toward its dumping position.

A means or mechanism 130 (FIGS. 7 through 9) in the form of a compression spring assembly is provided for a variety of functions including that of exerting an upwardly directed opening biasing force to the blower housing 30 to pivot or tilt the same about the axis Ha as the hopper 18 moves from the sweeping position shown in FIG. 5 to the dumping position shown in FIG. 3. Toward the latter end, the compression spring assembly 130 includes two pair of upper support plates 131, 131; 131, 131, each of a generally square configuration (FIGS. 3, 5 through 7) bridged across the top by a striker plate or contact plate 132 (FIGS. 3 and 7) and having forwardly facing edges (unnumbered) welded to the rear wall 39 of the blower housing 30. The striker plate 132 is beneath and vertically aligned with a striker pad 133 projecting downwardly from a reinforced collar 134 surrounding the conduit or pipe 26 of the hopper 18 (FIGS. 3 and 5). Each of the upper support plates 131 includes a circular opening 135 (FIG. 8) which are in axial alignment with each other.

The compression spring assembly 130 further includes a pair of lower support plates 141, 141 disposed in spaced parallel relationship to each other which are welded to a lower portion (unnumbered) of the frame 13, as is most evident in FIGS. 3, 5, 6, 7 and 8 of the drawings. Each of the plates 141 has five holes 142 in alignment with each other which function to adjust compression forces of a pair of compression springs 150, 150 while another pair of aligned openings 143 function to effect pivoting movement of the blower housing 30 from the sweeping position shown in FIG. 5 to the repair position shown in FIG. 6.

Figure 8:
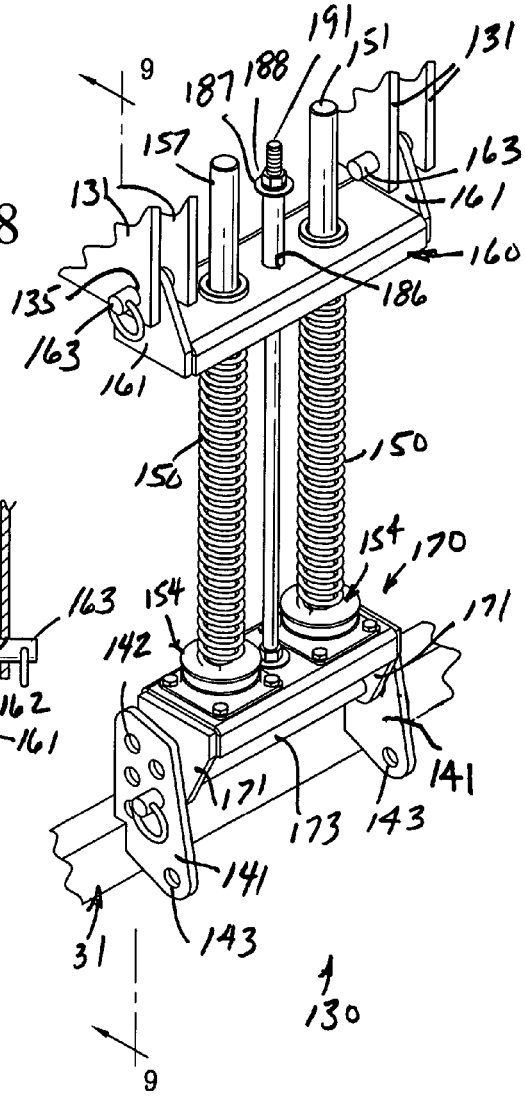
FIG. 8 is a fragmentary perspective view of the compression spring assembly, and illustrates details thereof including a pair of compression springs, upper and lower carrier plates, a central compression adjusting rod and a pair of apertured pivot plates for selectively variably adjusting compression force or set.
Figure 9:
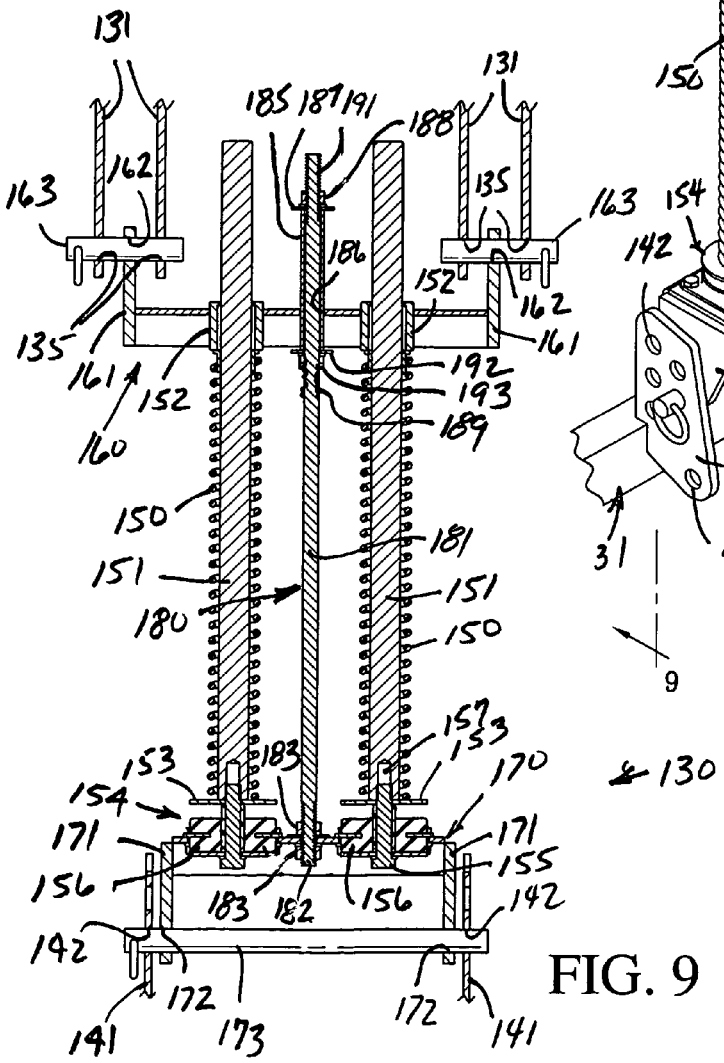
FIG. 9 is an enlarged cross-sectional view taken generally along 9-9 of FIG. 8, and illustrates further details of the components of the compression spring assembly.

An upper carrier plate 160 and a lower carrier plate 170 have respective flanges 161, 161 and 171, 171, each including an opening 162, 172, respectively, through which pass pivot pins 163, 163 and a single pivot pin 173 (FIG. 9). The pivot pins 163 pivotally connect the upper carrier plate 160 to the pairs of support brackets 131, 131; 131, 131, while the lower pivot pin 173 pivotally connects the lower carrier plate 170 with respect to the lower support brackets 141, 141 selectively through any one of the pairs of aligned openings 142, 143 (FIG. 8).

Each compression spring 150 surrounds a cylindrical compression spring guide member 151 which at an upper end passes through an associated sleeve 152 welded to the carrier plate 160. A lower end of each spring 150 rests upon a collar 153 which also supports a lower end of the compressing spring guide member 151. A sound and vibration dampening mounting 154 includes a bolt 155 fixed to a sound and vibration dampening elastomeric collar 156 bolted to the lower carrier plate 170 and threadably connected to an internal threaded bore 157 of each guide member 151. As is most readily apparent from FIG. 9 of the drawings, the compression springs 150 at all times exert a force tending to urge the carrier plates 160, 170 away from each other which corresponds to an upwardly directed force at all times tending to lift the carrier plate 160 upwardly and thereby through the support plates 131 pivot the blower housing 130 about the pivot axis Ha in a counterclockwise direction from the position illustrated in FIG. 5 to the position illustrated in FIG. 3 upon upward movement of the hopper 18.

Figure 6:
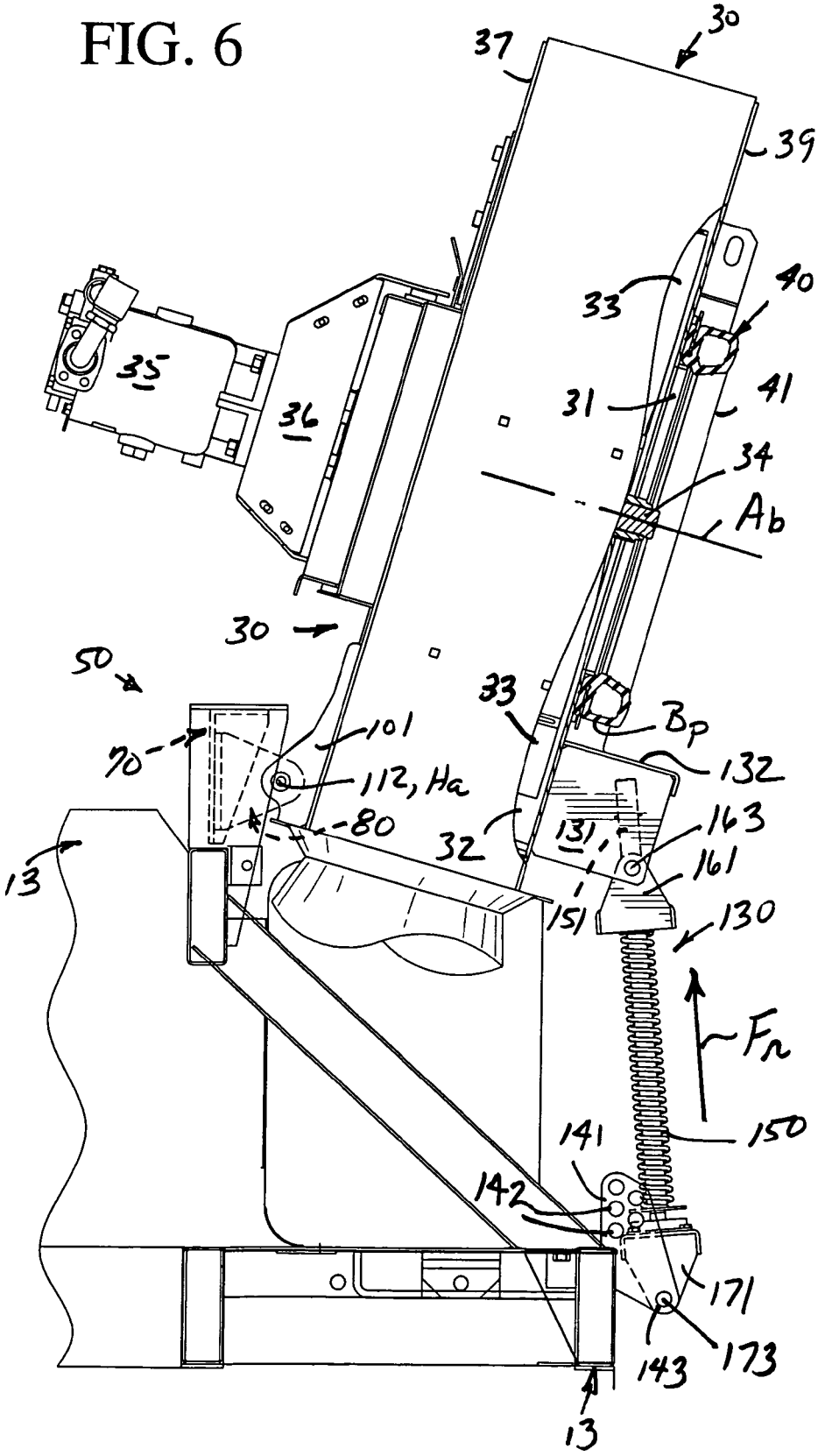
FIG. 6 is a fragmentary side elevational view with portions broken away for clarity similar to FIGS. 3 and 5, and illustrates the blower housing pivoted in a direction opposite to that illustrated in FIG. 3 depicting the repair position of the blower housing providing access to a hydraulic motor, an internal blower and associated components to facilitate repair without removing the entire blower housing from the road sweeper.

The compression spring assembly 130 further includes means or a mechanism 180 for adjustably limiting the maximum tilting or pivoting movement of the blower housing 30 between the two extreme relative positions thereof, namely, the dumping position of FIG. 3 and the repair position of FIG. 6. The blower housing pivotal movement limiting means 180 includes a rod 181 disposed substantially midway between and parallel to the compression springs 150, 150, as is evident in FIGS. 7 through 9 of the drawings. The rod 181 includes a lower threaded end 182 which passes through an opening (unnumbered) in the lower carrier plate 170 and is secured thereto by upper and lower nuts 183, 183 in a manner clearly evident from FIG. 9. An upper end of the rod 181 passes through a sleeve 185 which is slidable in an opening 186 of the upper carrier plate 160 (FIG. 8). A washer 187 is seated upon an upper end of the tube 185 and a nut 188 is threaded to an upper threaded end portion 191 of the rod 181. A similar washer 192 bears against a bottom edge of the sleeve 185 and therebeneath a nut 193 is threaded to a threaded portion 189 of the rod 181 (FIG. 9). As is most readily apparent in FIG. 9, depending upon the particular position of the blower housing 30, the upper carrier plate 160 will be spaced a particularly distance from the lower carrier plate 170 with the sliding motion therebetween being limited in a downward direction by the upper carrier plate 160 bottoming against the washer 192 and in the upper direction by the upper carrier plate 160 bottoming against the washer 187. In operation, the washer 187 limits pivotal or tilting movement of the blower housing 30 in the dumping position of FIG. 3 while the washer 192 limits tilting or pivoting movement of the blower housing 30 in the repair or servicing position of FIG. 6.

Operation

Figure 2:
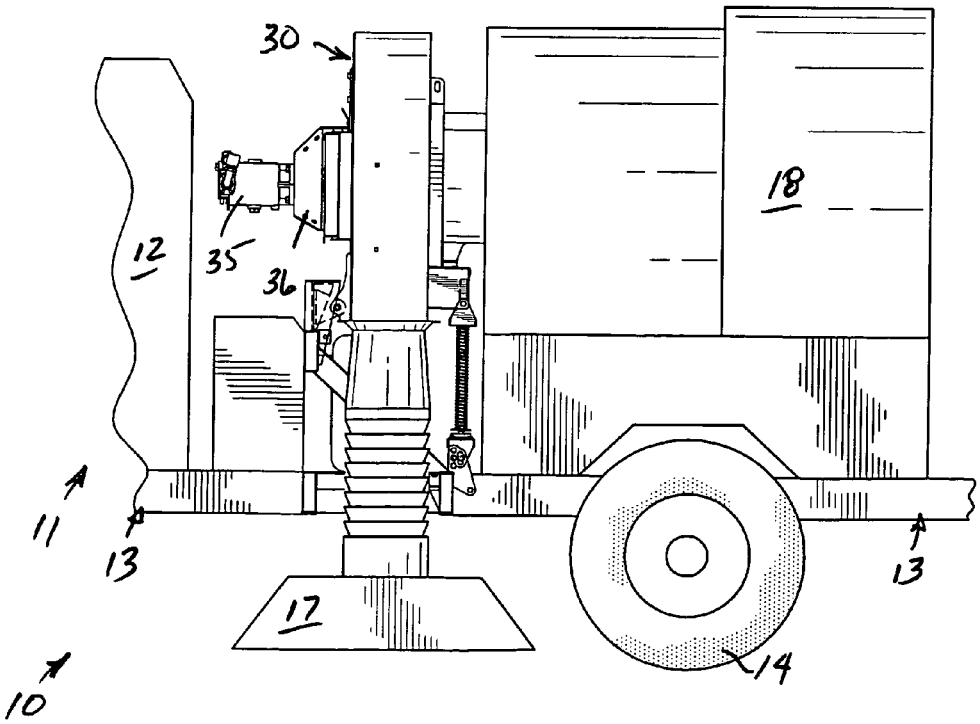
FIG. 2 is a fragmentary side elevational view, and illustrates the hopper and blower housings in the working or sweeping positions thereof, a pivotal connection between a lower forward edge of the blower housing and a frame of the road sweeper, and a compression spring assembly pivotally connected between a lower rear portion of the blower housing and a lower frame member of the road sweeper.
Figure 4:
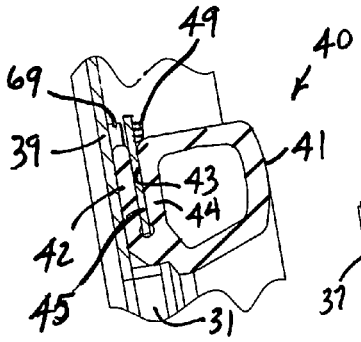
FIG. 4 is an enlarged fragmentary cross-sectional view of the encircled portion of FIG. 3, and illustrates cross-sectional details of the O-ring gasket and the manner in which the gasket is secured to one or more radially inwardly directed flanges of the blower housing.
Figure 7:
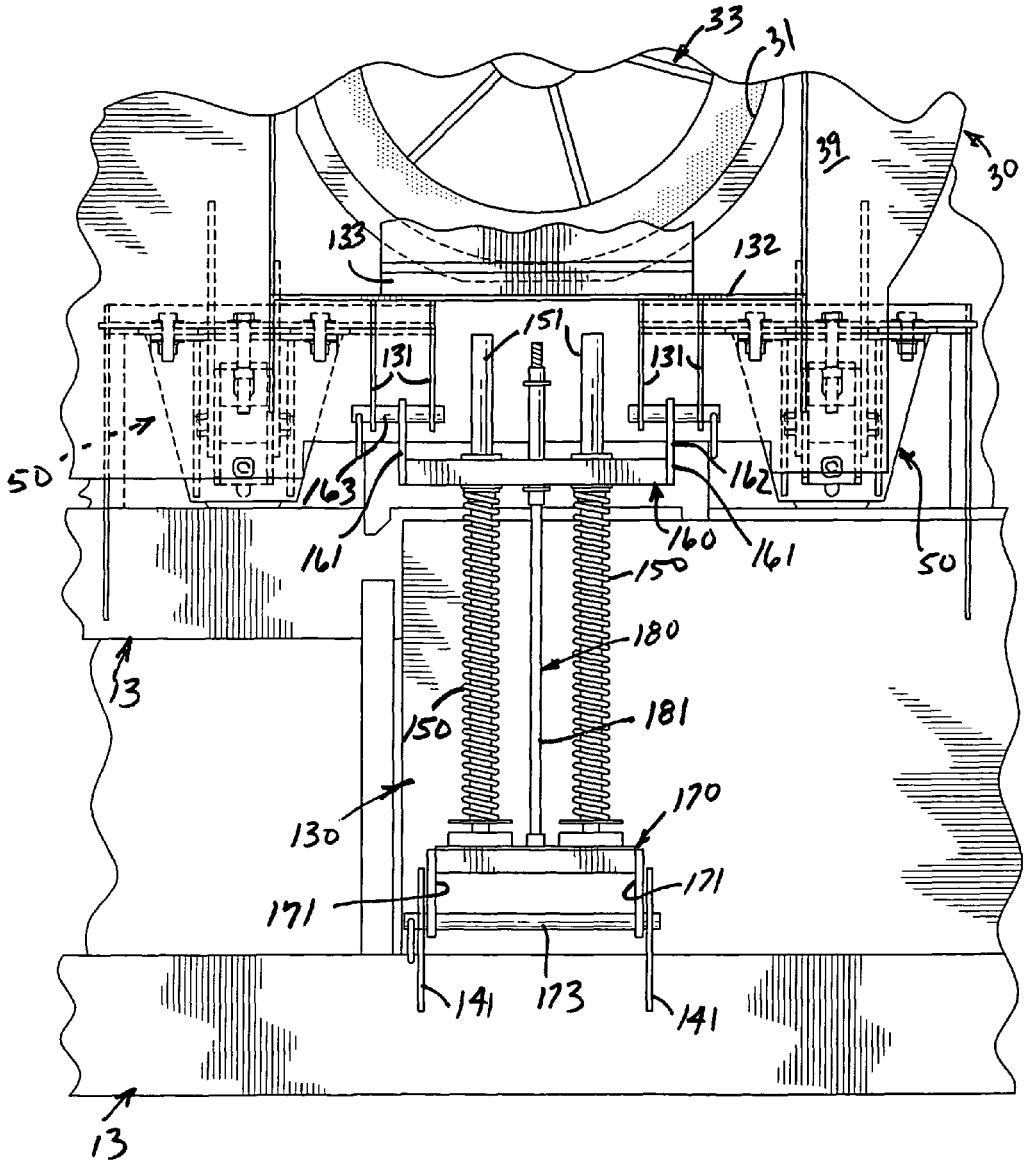
FIG. 7 is a fragmentary cross-section view taken along line 7-7 of FIG. 5, and illustrates the compression spring assembly, the manner in which the same is pivotally connected at lower and upper ends to the vehicle frame and blower housing, respectively, and to either side thereof adjusting mechanisms for adjusting each of two blower housing-to-vehicle frame pivots in X, Y and Z directions.

It is assumed that the sweeper 10 is operating in its working or sweeping mode or position which is that illustrated in FIGS. 2 and 5 of the drawings with the axes Ab, Ah of the blower housing opening 31 and the hopper opening 29 of the blower housing 30 and the hopper 18, respectively, being aligned (FIG. 5). As the vehicle 11 proceeds along a surface which is being swept/cleaned, debris enters the pick-up head 17 under the influence of an airstream created by the turbine blade 33 within the blower housing 30 and debris eventually is centrifugally separated and deposited within the debris compartment 25 of the hopper 18. During the sweeping operation, the gasket or O-ring seal 40 is in compressed intimate annular sealing engagement with the flange 27 (FIG. 5) of the hopper 18 in the substantially vertical plane Vs (FIG. 5) normal to the axes Ab, Ah. Since the blower housing 30 is essentially in its lowermost sweeping position, the compression springs 150 are partially compressed, much as is illustrated in FIGS. 7 and 8 of the drawings, noting that the washers 187, 192 are not bottomed against the carrier plate 160. Therefore, the compression springs 150 impart an opening or pivoting force Fd in an upward direction (FIG. 5), but pivoting movement of the blower housing 30 is precluded because the striker pad 133 of the hopper 18 bears against the striker plate 132 of the blower housing 30 and holds the same in the working or sweeping position of FIG. 5. The force Fd can be adjusted by positioning the pivot pin 173 in any one of the aligned five openings 142 of the plates 141. When the pin 173 is in the uppermost of the five openings 142, the compression springs 150 are compressed to a maximum and, therefore, the opening force Fd is at a maximum. When the pin 173 is placed through the lowermost of the five aligned openings 142, the opening force Fd is at a minimum. Adjustment of the force Fd is desirable for many reasons, particularly to afford increased forces as "compression set" decreases the design parameter force of the compression springs 150 over years of use.

Referring specifically to FIG. 5 of the drawings, the pivot axis Ha of the blower housing 30 is located an appreciable distance D below a lowermost or bottom edge of the openings 31, 29 and the gasket 40 in the sweeping position at which the axes Ab, Ah are aligned. The lowermost point of contact between the gasket 40 and the flange 27 is designated by Lp in FIG. 5 and, as the hopper 18 initially moves incrementally vertically upwardly through the operation of the fluid cylinder 23 and the linkage 21, the force Fd incrementally pivots the blower housing 30 for pivotal or tilting movement about the pivot axis Ha along a radius R (FIG. 5) which is the distance between the axis Ha and the point Lp to define a circumferential path of travel P. As the hopper 18 moves vertically, the sealing face defined by the flange 27 moves continuously in the substantially vertically sealing plane Vs but the bottom edge of the gasket 40 at the point Lp begins to virtually immediately move away from the lower portion of the flange 27 as the point Lp moves along the circumferential path of travel P. During the same pivoting movement of the blower housing 30 relative to the axis Ha, the upper point Up travels along a circumferential path of travel P1 defined by the radius R1. Since the furthest and uppermost portion or point Up of the gasket 40 is disposed on a greater radius R1 than the radius R, the point Up moves appreciably further from the sealing face of the flange 27 during the movement at the radially lowermost portion Bp of the gasket 40 and the lowermost point LP thereof, but the latter is sufficiently significant so to preclude excessive rubbing, abrading, sliding or the like of the gasket 40, as the force Fd progressively tilts the blower housing 30 from the position shown in FIG. 5 to the maximum open dumping position of FIG. 3 which is approximately 16 degrees to the vertical plane Vs. As is most readily apparent from FIG. 3, very limited or slight vertical raising movement of the hopper 18 from the position shown in FIG. 5 results in substantially immediate clearance of the O-ring seal 40 relative to the flange 27, particularly at the lowermost portion Bp thereof, and damage/abrasion to the O-ring seal 40 is substantially precluded. Obviously, return motion of the hopper 18 and the reverse pivoting movement of the blower housing 30 from the position shown in FIG. 3 to the position shown in FIG. 5 results in a similar reduction in abrasion, particularly during compression of the O-ring seal 40 from the position illustrated in FIG. 3 to the final compressed position of FIG. 5. The latter assures longer seal life of the O-ring seal 40 and, of course, efficient sealing between the openings 29, 31 and attendant increased efficiency in the sweeping operation.

Reference is made to FIG. 6 of the drawings which illustrates the blower housing 30 moved from the position shown in FIG. 5 to the servicing or repair position of FIG. 6. In order to achieve the position shown in FIG. 6, the force Fd (FIG. 5) exerted by the compression springs 150 must be reduced or eliminated and this is accomplished by inserting the pin 173 in the aligned openings 143 of the plates 141 which space the carrier plates 160, 170 sufficiently away from each other so as to reduce the force Fd to a lesser force Fr which counterbalances the weight of the blower housing 30 and the various components carried thereby, such as the hydraulic motor 35, the motor housing 36, the turbine blade or fan 33, etc. In the position shown in FIG. 6, the hopper 18 is obviously in a vertical position (not shown), such as illustrated in FIG. 1, which permits the blower housing 30 unobstructed pivoting to the servicing position of FIG. 6 which is approximately also 16 degrees to the vertical plane Vs. As was noted earlier, bolts which connect the housing 36, the fluid motor 35, the blower 33 and the shaft 34 to the blower housing 30 can be removed and the latter components can be readily removed by right-to-left movement, as viewed in FIG. 6 of the drawings. Upon appropriate inspection, repair, renovation or the like, the components are replaced and the blower housing 30 is pivoted back from the position illustrated in FIG. 6 to that illustrated in FIG. 5. Since the spring force Fr is a counterbalancing force, virtually little effort is required to manually pivot the blower housing 30 from the servicing position of FIG. 6 to the operative position of FIG. 5 at which point the pin 173 can be appropriately reinserted into a desired pair of the aligned openings 142 of the plates 141. At this point sweeping by the road sweeper 10 can continue and the operation is repeated as need be with appropriate adjustments to maintain alignment of the opening axes Ab, Ah being achieved through the adjustable pivotal mounting mechanisms 50 heretofore described, particularly the bolts and the cross slots associated with the L-beams, support members or support plates 60, 70 and 80 to achieve selected adjustment in the X, Y and Z planes.

Although a preferred embodiment of the invention has been specifically illustrated and described herein, it is to be understood that minor variations may be made in the apparatus without departing from the spirit and scope of the invention, as defined by the appended claims.

The invention claimed is:

1. A sweeper comprising a vehicle, a blower housing and a hopper carried by said vehicle, means for supporting said hopper for movement between a first sweeping position and a second dumping position, means for supporting said blower housing for movement between a first sweeping position and a second dumping position, means for moving said hopper from the first position toward the second position thereof, means for moving said blower housing from the first position toward the second position thereof, an opening in said blower housing and an opening in said hopper through which media flows when said blower housing and hopper are each in the first position thereof, and means for increasing the distance between the blower housing and the hopper upon rotational movement of said blower housing about a substantially horizontal axis from the first position thereof toward the second position thereof thereby providing clearance for hopper movement from the first sweeping position to the second dumping position.

2. The sweeper as defined in claim 1 wherein said distance increasing means includes pivot means of said blower housing supporting means about which said blower housing pivots during movement thereof from said blower housing first position toward said blower housing second position.

3. The sweeper as defined in claim 1 wherein said blower housing moving means is defined by biasing means.

4. The sweeper as defined in claim 1 wherein said distance increasing means includes pivot means of said blower housing supporting means about which said blower housing pivots during movement thereof from said blower housing first position toward said blower housing second position, and said pivot means is located radially outboard of said openings in said first positions.

5. The sweeper as defined in claim 1 wherein said blower housing moving means is defined by mechanical spring means.

6. The sweeper as defined in claim 1 including means for sealing said openings relative to each other in said hopper and blower housing first sweeping positions.

7. The sweeper as defined in claim 1 wherein said openings each include an axis, and said axes are substantially coaxially aligned in said first sweeping positions.

8. The sweeper as defined in claim 1 wherein said openings each include an axis, said axes are substantially coaxially aligned in said first sweeping positions, and said axes include therebetween a substantially acute angle in said second positions.

9. The sweeper as defined in claim 1 including means carried by said blower housing for sealing said openings relative to each other in said hopper and blower housing first sweeping positions.

10. The sweeper as defined in claim 1 wherein said blower housing supporting means support said blower housing for movement between the first sweeping position thereof and a third position adapted for servicing blower components carried by said blower housing.

11. The sweeper as defined in claim 1 wherein said blower housing supporting means support said blower housing for movement between the first sweeping position thereof and a third position adapted for servicing blower components carried by said blower housing, and the blower housing first sweeping position is located between the second dumping and third servicing positions thereof.

12. The sweeper as defined in claim 1 wherein said blower housing supporting means support said blower housing for movement between the first sweeping position thereof and a third position adapted for servicing blower components carried by said blower housing, said blower housing opening and hopper opening each include an axis and a plane through each opening which is substantially normal to the associated opening axis, said axes being substantially coaxially aligned in said blower housing and hopper first sweeping positions, and said opening planes set off one of an upwardly opening and a downwardly opening acute angle when said blower housing is in one of the second dumping and the third servicing positions thereof.

13. The sweeper as defined in claim 1 wherein said blower housing supporting means support said blower housing for movement between the first sweeping position thereof and a third position adapted for servicing blower components carried by said blower housing, said blower housing opening and hopper opening each include an axis and a plane through each opening which is substantially normal to the associated opening axis, said axes being substantially coaxially aligned in said blower housing and hopper first sweeping positions, and said planes set off an upwardly opening acute angle when said blower housing is in the second dumping position thereof.

14. The sweeper as defined in claim 1 wherein said blower housing supporting means support said blower housing for movement between the first sweeping position thereof and a third position adapted for servicing blower components carried by said blower housing, said blower housing opening and hopper opening each include an axis and a plane through each opening which is substantially normal to the associated opening axis, said axes being substantially coaxially aligned in said blower housing and hopper first sweeping positions, and said opening planes set off a downwardly opening acute angle wherein said blower housing is in the third servicing position thereof.

15. The sweeper as defined in claim 1 wherein said blower housing supporting means support said blower housing for movement between the first sweeping position thereof and a third position adapted for servicing blower components carried by said blower housing, said blower housing opening and hopper opening each include an axis and a plane through each opening which is substantially normal to the associated opening axis, said axes being substantially coaxially aligned in said blower housing and hopper first sweeping positions, said planes set off an upwardly opening acute angle when said blower housing is in the second dumping position thereof, said opening planes set off a downwardly opening acute angle wherein said blower housing is in the third servicing position thereof.

16. The sweeper as defined in claim 1 wherein said blower housing moving means is defined by mechanical spring biasing means for biasingly urging said blower housing from the first sweeping position toward the second dumping position thereof, and means for loading said spring biasing means during movement of said hopper from the second dumping position toward the first sweeping position thereof.

17. The sweeper as defined in claim 1 wherein said vehicle includes a frame, and said distance increasing means includes pivot means of said blower housing supporting means between said frame and blower housing about which said blower housing pivots during movement thereof from said blower housing first position toward said blower housing second position.

18. The sweeper as defined in claim 1 wherein said vehicle includes a frame, and said distance increasing means includes pivot means of said blower housing supporting means between said frame and blower housing about which said blower housing pivots during movement thereof from said blower housing first position toward said blower housing second position, and said blower housing moving means is defined by biasing means disposed between said blower housing and said frame.

19. The sweeper as defined in claim 1 wherein said vehicle includes a frame, and said distance increasing means includes pivot means of said blower housing supporting means between said frame and blower housing about which said blower housing pivots during movement thereof from said blower housing first position toward said blower housing second position, said blower housing moving means is defined by biasing means disposed between said blower housing and said frame, and first and second pivot means for pivotally connecting said biasing means respectively to said frame and to said blower housing.

20. The sweeper as defined in claim 1 wherein said substantially horizontal axis comprises at least one axial bolt coaxially aligned along said substantially horizontal axis.

21. A sweeper comprising a vehicle, a blower housing and a hopper carried by said vehicle, means for supporting said hopper for movement between a first sweeping position and a second dumping position, means for supporting said blower housing for movement between a first sweeping position and a second repair position, means for moving said hopper from the first position toward the second position thereof, means for effecting rotational movement of said blower housing about a substantially horizontal axis from the first sweeping position toward the second repair position thereof, an opening in said blower housing and an opening in said hopper through which media flows when said blower housing and hopper are each in the first position thereof, said openings each having an axis which are coaxially aligned in said first positions, a sealing plane of said openings in said first positions being substantially normal to said aligned axes in said first positions, said blower opening axis in said blower housing second repair position defining a downwardly opening acute angle relative to the sealing plane of said openings in said first positions.

22. The sweeper as defined in claim 21 including means for imparting a biasing force to said blower housing for moving said blower housing to a third dumping position, and means for at least reducing said biasing force to effect ease of movement of said blower housing from said first sweeping position to said second repair position.

23. The sweeper as defined in claim 22 wherein said biasing force effecting means includes at least one compression spring, and said biasing force reducing means is effecting to lengthen said at least one compression spring.

24. The sweeper as defined in claim 21 wherein said substantially horizontal axis comprises at least one axial bolt coaxially aligned along said substantially horizontal axis.

* * * * *